United States Patent [19]

Hirota et al.

[11] Patent Number: 4,591,677

[45] Date of Patent: May 27, 1986

[54] THREE-FUNCTION PRESSURE SWITCH

[75] Inventors: Hisatoshi Hirota, Hachioji; Toyoyuki Hara, Fuchu; Masaichi Kawahata, Hachioji, all of Japan

[73] Assignee: TGK Company, Limited, Hachioji, Japan

[21] Appl. No.: 699,398

[22] Filed: Feb. 7, 1985

[51] Int. Cl.[4] ..... H01H 35/34

[52] U.S. Cl. ..... 200/83 J; 200/83 P; 200/81.4

[58] Field of Search ..... 73/861.47, 717, 723, 73/744, 745; 340/626; 92/5 R, 98 R, 101; 307/118; 200/81 R, 81.4, 81.5, 82 R, 83 J, 83 P

[56] References Cited

U.S. PATENT DOCUMENTS

| | | | |
|---|---|---|---|
| 3,657,501 | 4/1972 | Hoyt | 200/81.5 |
| 4,296,287 | 10/1981 | Boulanger | 200/83 P |
| 4,400,601 | 8/1983 | Brucken | 200/81.4 |
| 4,473,729 | 9/1984 | Ting | 200/83 J |

FOREIGN PATENT DOCUMENTS 58-169636 11/1983 Japan .

*Primary Examiner*—G. P. Tolin

*Attorney, Agent, or Firm*—Wenderoth, Lind & Ponack

[57] ABSTRACT

There is provided a three-function pressure switch adapted to be provided on the higher pressure side of the cooling cycle circuit in an automobile cooling device.

The three-function pressure switch comprises a casing including a pressure inlet and a pressure receiving chamber, a diaphragm disposed within the pressure receiving chamber across the chamber, a first resilient disc disposed below the diaphragm for resilient warping subject to pressure from the chamber through the diaphragm, a first piston positioned below the disc for vertical movement as the disc warps, a holder for engaging the first piston, a second resilient disc disposed below the holder for warping as the holder moves, a first electrical switching section adapted to opened and closed by the first resilient disc and a second electrical switching section adapted to be opened and closed by the second resilient disc.

1 Claim, 6 Drawing Figures

THREE-FUNCTION PRESSURE SWITCH

BACKGROUND OF THE INVENTION

This invention relates to a three-function pressure switch device adapted to be provided in the coolant passage on the higher pressure side of the cooling cycle circuit for the cooling device in an automobile and comprising a switch for interrupting the operation of a compressor by opening the electrical contacts on the cooling cycle circuit when the pressure on the higher pressure side of the cooling circuit abnormally decreases or increases and a switch capable of optionally determining pressure for opening or closing the electrical contacts.

There have been proposed and practically employed a variety of three-function pressure switches and the prior art three-function switches have been developed taking the backgrounds into consideration:

A. When the coolant in the cooling cycle circuit leaks out of the circuit to cause coolant shortage in the circuit, the compressor associated with the circuit tends to break. Especially, when the coolant shortage is substantial, the pressure on the higher pressure side decreases to an abnormal level and thus, it is necessary to provide a low pressure switch which senses the decrease in pressure and opens the electrical contacts of the circuit to thereby interrupt the operation of the compressor for prevention of breakage of the compressor.

B. When the cooling load on the cooling cycle circuit is excessively high or the capacity of the compressor decreases due to any cause, the pressure on the higher pressure side of the cooling cycle circuit increases to an abnormally high level. In such a case, it is required to interrupt the operation of the cooling cycle circuit and thus, for the purpose, there is the necessity for provision of a switch which senses such abnormally high pressure and opens the electrical contacts. However, when the operation of the compressor is interrupted in response to the abnormal increase in pressure, the pressure decreases rapidly to the normal level and the pressure switch returns to the normal condition in which the compressor resumes its operation. In such a case, if there is no differential pressure for opening and closing the switch, the switch frequently opens and closes and thus, the electrical contacts on the higher pressure side of the cooling cycle circuit should be provided with differential pressure.

C. In order to maintain the pressure on the higher pressure side of the cooling cycle circuit within a predetermined normal range regardless of the magnitude of cooling load when the pressure on the higher pressure side of the cooling cycle circuit at the normal level, in some cases, the compression capacity of the compressor is controlled. For this purpose, it is necessary to a mechanism which closes the electrical contacts so as to increase the compression capacity of the compressor when the pressure on the higher pressure side of the cooling cycle circuit exceeds a predetermined level and opens the electrical contacts when the pressure on the higher pressure side of the cooling cycle circuit drops to a value smaller than the predetermined value and it is also necessary to provide a pressure switch which responds to differential pressure for opening and closing the electrical contacts, respectively.

Any one of the above-mentioned three types of pressure switches have to be provided in the coolant passage on the higher pressure side of the cooling cycle circuit.

One example of the prior art three-function or complex pressre switches is shown in Japanese Laid-Open Utility Model Application No. 169,636/1983. The prior art three-function or complex pressure switch generally comprises a casing including an upper casing portion 2 provided with a center coaxial pressure inlet 1 and a lower casing portion 3 integrally connected to the upper casing portion, a diaphragm 4 pinched at the periphery between the upper and lower casing portions 2, 3 to define a pressure receiving chamber 6 in the upper casing portion 2, a piston assembly positioned within the upper casing portion below the diaphragm and including coaxial outer and inner pistons 13, 14 operable independently of each other, a spring-loaded vertically movable member 21 positioned within the lower casing portion 3 below the piston assembly for vertical movement in response to the vertical movement of the piston assembly and including a reduced diameter projection 29 extending downwardly therefrom, a first electrical switching section 45 mounted on a lower part of the lower casing portion 3 for opening and closing in accordance with an amount of the downward movement of the movable member 21, a spring 22 surrounding the movable member 21 for normally biasing the member upwardly against pressure acting on the upper surface of the piston assembly 13, 18 through the diaphragm 4, a resilient disc 35 extending across an upper portion of the movable member 21 in contact with the undersurface of the inner piston 18, and a second electrical switching section 37 mounted on the lower part of the lower piston portion 3 for opening and closing as the resilient disc resiliently warps in opposite directions.

Although the three-function pressure switch of the Japanese utility model application has the first electrical switching section 45 on the intermediate pressure side and the second electrical switching section 37 on the highest pressure side and the second electrical switching section 37 is associated with the resilient disc 35, the first electrical switching section 45 cannot be provided with any resilient disc because of the specific construction of the section. Thus, the pressure switch is manipulated by causing the electrical elements associated with the second electrical switching section 45 to engage with or disengage from each other by means of the movable member 21 to which external force is applied. However, a movable electrical wire has to be provided between the terminal electrically connected to the movable member and the external lead for operating the electrical elements which complicates the construction of the pressure switch and makes it difficult to assemble the switch.

SUMMARY OF THE INVENTION

Therefore, the present invention is to provide a three-function pressure switch which eliminates the disadvantages inherent in the prior art three-function pressure switches.

The three-function pressure switch of the invention essentially comprises a casing including an upper casing portion provided with a center axial pressure inlet and a lower casing portion integrally secured to the upper casing portion, a diaphragm pinched at the periphery between the upper and lower casing portions to define a pressure-receiving chamber within the upper casing portion in communication with the pressure inlet, a first resilient disc disposed within the pressure receiving chamber below the diaphragm for resilient warping subject to pressure from the pressure receiving chamger, a first piston disposed within the upper casing portion below the resilient disc for vertical movement, a holder received within the lower casing portion for engaging the piston, a second resilient disc disposed for resilient warping as the holder moves vertically, a second piston receiving the second resilient disc, a spring-loaded piston body normally being biased upwardly within the lower casing portion below the second piston, a first electrical switching section mounted within the holder for opening and closing by the first resilient disc, a second electrical switching section mounted within the piston body for opening and closing by the second resilient disc and first and second terminals extending through the lower casing portion with the lower ends projecting out of the lower casing portion and electrically connected to the first and second electrical switching sections, respectively.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

PREFERRED EMBODIMENT OF THE INVENTION

Figure 1:
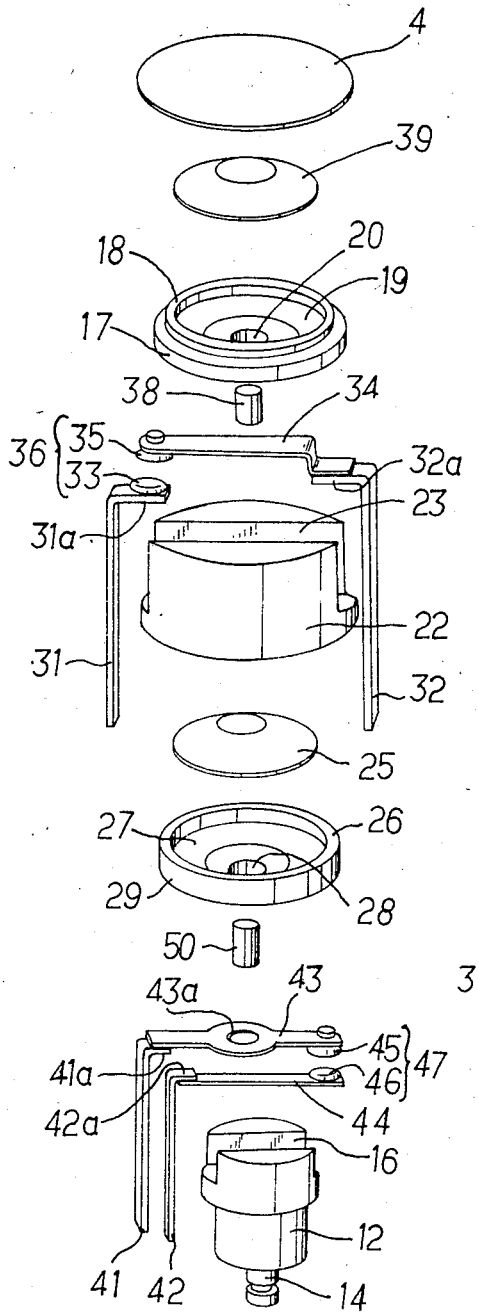
FIG. 1 is an exploded perspective view of the preferred embodiment of the three-function pressure switch with the upper and lower casing portions thereof removed therefrom.
Figure 2:
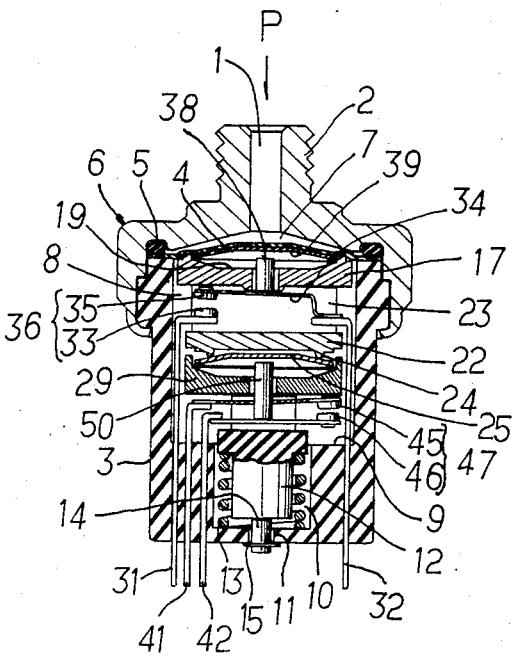
FIGS. 2, 3, 4 and 5 are vertically sectional views of the three-function pressure switch showing the same in different operative conditions.
Figure 3:
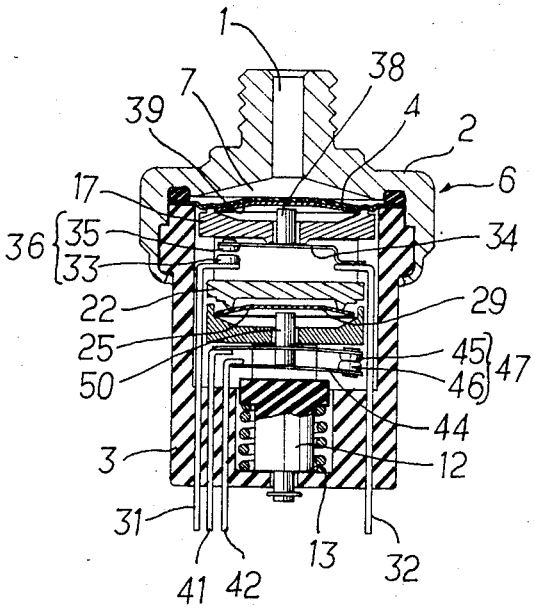

The present invention will be now described referring to the accompanying drawings in which one preferred embodiment of the three-function pressure switch according to the invention is illustrated. The three-function pressure switch generally comprises a main body or casing 6 which includes an upper casing portion 2 having a center coaxial pressure inlet 1 in an upper part thereof and a lower casing portion 3 secured to the upper casing portion as an integral unit. The periphery of a diaphragm 4 and an annular packing 5 are pinched between the upper and lower casing portions 2, 3 to provide a seal there. The diaphragm 4 defines in a lower part of the upper casing portion 2 a pressure receiving chamber 7 which is in communication with the pressure inlet 1. A first resilient disc 39 is disposed within the chamber below the diaphragm 4. The lower casing portion 3 is formed of insulation and defines a chamber 8 therein. The bottom 9 of the chamber 8 is formed at the central area thereof with a recess 10 the bottom of which is formed with a center axial opening 11 which is in communication at the upper end with the recess 10 and at the lower end with the atmosphere, respectively. A piston body 12 is received within the recess 11 for vertical movement and normally urged upwardly under the force of a spring 13 surrounding the piston. A reduced diameter projection 14 extends downwardly from the lower end of the piston body 12 at the central area thereof through the opening 11 to the exterior of the casing 6. A stop ring 15 is secured to a position adjacent to the lower end of the projection 14 outside of the casing 6 to limit the upward movement of the piston body 12. The upper end face of the piston body 12 is formed with a diametrical groove 16 for the purpose to be described hereinafter. A first piston 17 is received within the pressure receiving chamber 8 for vertical movement and includes an annular upwardly extending projection 18 adjacent to the periphery of the piston and an annular recess 19 positioned inwardly of the projection 18 and provided at the central area thereof with a through hole 20. A holder 22 is provided within an upper part of the chamber 8 defined by the lower casing portion 3 below the piston 17. The holder 22 is formed at the upper end face with a diametrical recess 23 and on the undersurface with an annular projection 24 extending downwardly. A second piston 29 is provided below the holder 22 and includes an upright annular projection 26 at the periphery to define a recess 27 having a center through hole 28. A second resilient disc 25 is received within the annular projection 26 and held in position by the above-mentioned holder 22. A pair of parallel and spaced first terminals 31, 32 extend vertically through the lower casing portion 3 with the lower ends project downwardly beyond the bottom of the casing portion and the upper ends bent inwardly towards each other to form bent pieces 31*a*, 32*a*, respectively, which are positioned in the recess 23 in the holder 22. One of the bent pieces 31*a* has a first stationary contact 33 secured thereto and the other bent piece 32*a* has the base end of a first leaf spring 34 secured thereto and the spring has a first movable contact 35 secured thereto in opposition to the first stationary contact 33 whereby the first stationary and movable contacts 33, 35 provide a first electrical switching section 36. A rod 38 is received in the through hole 20 in the first piston 17 with the upper end of the rod for engaging the first resilient disc 39 associated with the first piston 17 and the lower end engaging the first leaf spring 34. A pair of parallel and spaced second terminals 41 and 42 having lengths shorter than the first terminals 31, 32 extend vertically through the lower casing portion 3 between the first terminals 31, 32. The lower ends of the second terminals 41, 42 also project downwardly from the bottom of the casing portion 3 and the upper ends of the terminals are bent inwardly in different heights to provide bent pieces 41*a*, 42*a*, respectively, which are received in the recess 16 in the piston body 12. Upper and lower second leaf springs 43, 44 are secured at the base ends to the bent pieces 41*a*, 42*a*, respectively. The leading end of the upper leaf spring 43 has a second movable contact 45 secured to the undersurface thereof whereas the leading end of the leaf spring 44 has a second movable contact 46 secured to the upper surface thereof in opposition to the contact 45 whereby the second movable contacts 45, 46 provide a second electrical switching section 47. The upper leaf spring 43 is formed in the center thereof with a through hole 43*a* in alignment with the through hole 28 in the second piston 29. A second rod 50 is received in the aligned holes 28, 43*a* in the second piston 29 and leaf spring 43, respectively with the upper end of the rod for engaging the undersurface of the second resilient disc 25 at the central area thereof and the lower end engaging the upper surface of the lower leaf spring 44. Although the first terminals 31, 32 and the second terminals 41, 42 are actually spaced from each other by 90°, the positions of these terminals as shown in the drawings for convenience of illustration.

Figure 6:
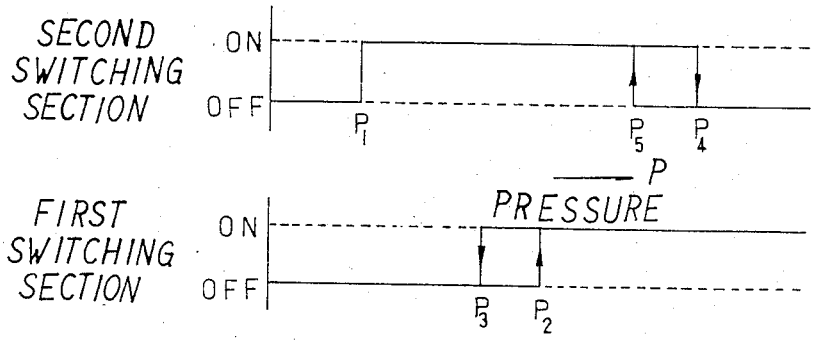
FIG. 6 is a view showing the relationship between the electrical switching sections and set pressures in the three-fuction pressure switch.

With the above-mentioned construction and arrangement of the components of the three-function pressure switch according to the present invention, in operation, pressure is introduced from an external pressure source (not shown) through the pressure inlet 1 into the pressure receiving chamber 7 and when the pressure is at a value smaller than a first set pressure $P_1$ as shown in FIG. 6, the piston body 12 is pushed upwardly under the force of the spring 15 until the stop ring 15 at the lower end of the piston body engages the bottom of the lower casing portion 3 and the upwardly moving piston body 12 in turn pushes the second piston 29 upwardly through the second rod 50. As the second piston 29 is pushed upwardly, the holder 22 and first piston 17 are also pushed upwardly through the second resilient disc 25 to thereby open the first and second electrical switching sections 36, 47. At this time, the force applied to the second piston 29 by the pressure within the pressure receiving chamber 7 is represented by force $F_1$ (kg) which is the product of the effective pressure receiving area S ($cm^2$) provided by the first piston 17, lower casing porton 3 and diaphragm 4 and pressure P ($kg/cm^2$) and the force $F_1$ (kg) is downwardly applied to the second piston 29 through the first piston 17, holder 22 and second resilient disc 25. On the other hand, the force $F_2$ (kg) of the spring 13 is transmitted to the first piston 17 through the piston body 12, second piston 29, second resilient disc 25 and holder 22, whereby:

$P \times S = F_1 < F_2$ Upward movement of the first and second pistons $P \times S = F_1 > F_2$ Downward movement of the first and second pistons Thus, the value $P_1$ of P in which $F_1 = F_2$ becomes the first set pressure and a force having a value smaller than the first set pressure cannot push the first and second pistons upwardly.

Next, when the pressure within the pressure receiving chamber 7 increases to a value greater than the first set pressure $P_1$, the increased pressure within the chamber pushes the second piston 29 downwardly through the first piston 17, holder 22 and second resilient disc 25 against the force of the spring 13 whereby the upper second leaf spring 43 is pushed down to cause the contact 45 on the leaf spring to engage the contact 46 on the lower leaf spring 44 to thereby close the second electrical switching section 47. In this case, since the resilient discs 25, 39 have not yet resiliently warped downwardly, the rods 38, 50 are not pushed downwardly and thus, the first electrical switching section 36 remains open.

Figure 4:
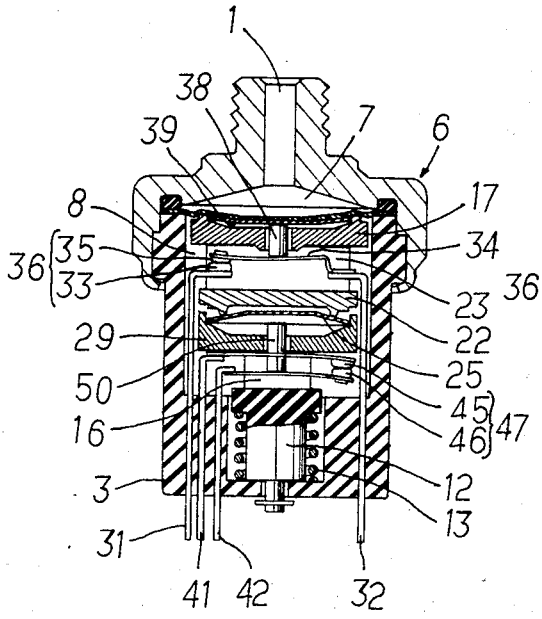
Figure 5:
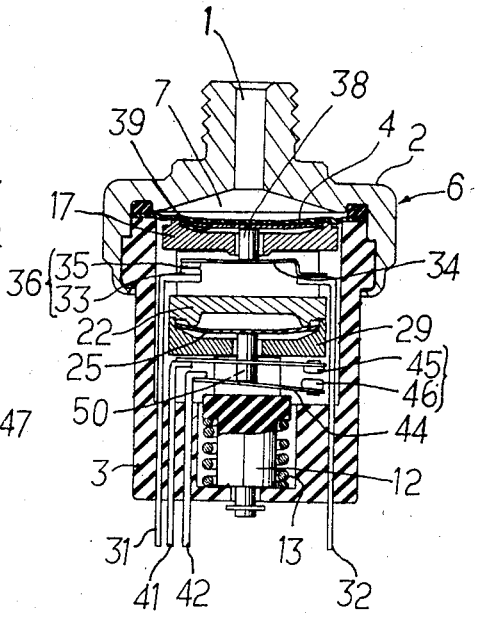

Thereafter, when the pressure within the pressure receiving chamber 7 increases to a value greater than a second set pressure $P_2$, the first resilient disc 39 warps downwardly subjected to the increased pressure to push the first rod 38 downwardly and the rod 38 in turn pushes the first leaf spring 34 downwardly to thereby close the first electrical switching section 36. In this case, the second resilient disc 25 has not yet warped downwardly and as a result, the second electrical switching section 47 remains open (FIG. 4).

Thereafter, when the pressure within the pressure receiving chamber 7 increases to a value greater than a fourth set pressure $P_4$, the second resilient disc 25 also resiliently warps downwardly subjected to the increased pressure and pushes the lower second leaf spring 44 through the second rod 50 to thereby open the second electrical switching section 47. In the illustrated embodiment, the first resilient disc 39 is designed to warp downwardly at a pressure greater than the second set pressure $P_2$ and return or warp upwardly at a pressure greater than the second set pressure $P_2$ whereas the second resilient disc 25 is designed to warp downwardly at a pressure greater than the fourth set pressure $P_4$ and return or warp upwardly at a pressure smaller than the fourth set pressure $P_4$. As mentioned hereinabove, in the three-function pressure switch according to the present invention, the two electrical switching sections operate by differential pressure and the terminals having their contacts for closing and opening the respectively associated electrical switching sections are secured to the lower casing portion against movement and thus, the opening and closing timings of the wirings connected to the terminals and of the contacts secured to the terminals will not vary to thereby ensure positive closing and opening of the electrical switching sections.

Therefore, the present invention has the following advantageous effects:

1. Since the terminals having the electrical switching sections are secured to the casing of the pressure switch, the electrical switching sections will not displace in response to variation in pressure and thus, the timings of the opening and closing of the contacts on the terminals remain unchanged.

2. By the use of the resilient discs, the size and weight of the pressure switch can be minimized.

3. Since the set pressures are independent of each other, the adjustment of the pressures is simple and easy.

4. Since the electrical switching sections are opened and closed as the resilient discs warp in one and the other directions, switching can be momentarily performed.

5. By the provision of different pressures to which the elements respond, chattering of the contacts can be prevented to thereby eliminate occurrence of noise in operation. In addition, the service life of the contacts can be prolonged.

While only one embodiment of the invention has been shown and described in detail, it will be understood that the same is for illustration purpose only and not to be taken as a definition of the invention, reference being had for this purpose to the appended claims.

What is claimed is:

1. A three-function pressure switch comprising a casing including an upper casing portion provided with a center coaxial pressure inlet and a pressure receiving chamber and a lower casing portion integrally secured to said upper casing portion, a diaphragm pinched at the periphery between said upper and lower casing portions, a first resilient disc disposed in contact with the undersurface of said diaphragm for warping subjected to pressure from said chamber through said diaphragm, a first piston receiving said first resilient disc and vertically movable in response to warping of said disc, a holder disposed within said lower casing portion for vertical movement to engage and separate from said first piston, a second pistion disposed below said holder, a second resilient disc received in said second piston for warping in response to vertical movement of said holder, a spring-loaded piston body disposed below said second piston for vertical movement, a first electrical switching section adapted to be opened and closed by said first resilient disc, a second electrical switching section adapted to be opened and closed by said second resilient disc and first and second terminal means electrically connected to said first and second electrical switching sections, respectively.

2. The three-function pressure switch as set forth in claim 1, in which said first terminal means comprise a first pair of terminals extending vertically through said lower casing portion with the lower ends projecting downwardly from the bottom of the casing portion and the upper ends bent towards each other to provide first bent pieces and one of said first bent pieces has a stationary contact secured thereto and the other first bent piece supports the base end of a leaf spring which supports a movable contact at the leading end for engaging said stationary contact to thereby provide said first electrical switching section and said second terminal means comprise a second pair of terminals having lengths shorter than said first pair of terminals and extending vertically through said lower casing portion with the lower ends projecting downwardly from the bottom of the casing portion and the upper ends being bent in different heights towards each other to provide second bent pieces and one of said second bent pieces supports the base end of a leaf spring which supports a movable contact at the leading end and the other second bent piece supports the base end of another leaf spring which supports a movable contact at the leading end for engaging said movable contact on the one second leaf spring to thereby provide said second electrical switching section.

* * * * *